US005356689A

United States Patent [19]

Pechhold

[11] Patent Number: 5,356,689

[45] Date of Patent: Oct. 18, 1994

[54] PROCESS PROVIDING DURABLE STAIN-RESISTANCE USING METHACRYLIC ACID POLYMERS

[75] Inventor: Engelbert Pechhold, Chadds Ford, Pa.

[73] Assignee: E. I. Du Pont de Nemours and Company, Wilmington, Del.

[21] Appl. No.: 51,824

[22] Filed: Apr. 26, 1993

[51] Int. Cl.[5] ..... B32B 3/02

[52] U.S. Cl. ..... 428/96; 8/115.54; 8/115.6; 427/386; 427/393.4; 428/267

[58] Field of Search ..... 8/115.54, 115.6; 427/386, 393.4, 96, 267

[56] References Cited

U.S. PATENT DOCUMENTS 4,081,383 3/1978 Warburton et al. ..... 252/8.6
4,794,036 12/1988 Tate ..... 428/263
4,822,373 4/1989 Olson et al. ..... 8/115.6
4,937,123 6/1990 Chang et al. ..... 428/96

*Primary Examiner*—Michael Lusignan
*Attorney, Agent, or Firm*—Charles E. Feeny

[57] ABSTRACT

Process for imparting to polyamide substrates resistance to staining by acid dyes which is durable to shampooing and resistance to yellowing caused by exposure to UV and/or $NO_x$, comprising applying to said substrate (A) one or more epoxy resins and (B) a polymeric stain-resist agent consisting essentially of (i) copolymers containing more than 75 weight percent methacrylic acid and less than 25 weight percent of one or more other ethylenically unsaturated monomers, or (ii) polymers prepared by polymerizing (a) methacrylic acid or (b) mixtures of methacrylic acid and one or more other ethylenically unsaturated monomers, in the presence of a sulfonated hydroxyaromatic-formaldehyde condensation product.

11 Claims, No Drawings

PROCESS PROVIDING DURABLE STAIN-RESISTANCE USING METHACRYLIC ACID POLYMERS

FIELD OF THE INVENTION

The present invention relates to novel compositions and processes which are effective in imparting to polyamide fiber substrates more durable resistance to staining caused by acid dyes; it relates also to the resulting treated substrates.

BACKGROUND OF THE INVENTION

It is well-known to treat polyamide substrates, such as carpeting, with compositions which impart resistance to staining by an acid dye, such as FD&C Red Dye No. 40. Such compositions are commonly referred to as stain-resists or stain-resist agents.

For example, one class of known stain-resist agents comprises one or more sulfonated hydroxyaromatic-formaldehyde condensation products, for example, phenol-formaldehyde condensation products or formaldehyde-naphthol condensates. When stain-resist agents based on such condensation products are applied to polyamide substrates, they provide acid dye stain-resistance which resists removal by shampooing. But such treated substrates are prone to yellowing on exposure to ultraviolet light (UV) or to nitrogen oxides ($NO_x$), or to combinations of UV and $NO_x$ exposure.

Another class of known stain-resists involves the use of carboxyl group-containing polymers; for example, methacrylic acid homopolymers and copolymers. Due to the ionic character of carboxy group-containing stain-resist agents, polyamide fiber substrates treated with such stain-resists tend to be sensitive to high pH values, such as those that may often be encountered in commercial rug shampoos. As a result, in some cases, stain-resistance is partially or completely lost following shampooing. The carboxy-group-containing stain-resist agents show better resistance to yellowing on exposure to UV or $NO_x$ or a combination of UV and $NO_x$, but poorer resistance to removal by shampooing than the sulfonated phenol-formaldehyde condensates.

Compositions based on sulfonated phenol-formaldehyde condensates combined with polymers of methacrylic acid or hydrolyzed copolymers of maleic anhydride and ethylenically unsaturated compounds, when applied to polyamide substrates, will provide resistance to staining by acid dyes. While some improvement is also obtained in resistance to yellowing caused by UV and/or $NO_x$ and resistance to removal by commercial shampooing, it is far from optimum.

Yet another class of stain-resist agents comprises products prepared by polymerizing methacrylic acid, or methacrylic acid and one or more ethylenically unsaturated comonomers in the presence of sulfonated aromatic formaldehyde condensates. While the carboxylic acid-containing stain-resist agents overcome some of the discoloration problem caused by UV and/or $NO_x$, they lack adequate resistance to removal in commercial shampooing.

Epoxy resins can be cured with carboxylic or polycarboxylic acids, and epoxy resins in combination with carboxylic acid-containing polymers can be applied to fiber substrates. For example, combinations of epoxy resins and copolymers of methacrylic acid have been applied to carpets and carpet yarns as anti-soilants for carpets and carpet yarns. However, unsatisfactory performance was reported for poly(methacrylic acid) or copolymers with more than 75 wt. % of methacrylic acid, with or without epoxy resins. Moreover, there is no disclosure of using such compositions for imparting to polyamide substrates resistance to staining caused by acid dyes.

In view of the above-described considerations, it is apparent that there is a need to provide stain-resists for polyamide substrates which combine resistance to removal during commercial shampooing and resistance to yellowing caused by UV or $NO_x$ or both.

BRIEF SUMMARY OF THE INVENTION

The present invention provides compositions and processes of using them which at the same time impart resistance to staining of polyamide substrates caused by acid dyes which is durable to shampooing and resistance to yellowing caused by exposure to UV and/or $NO_x$. It has been found in accordance with the present invention that the stain-resist performance of methacrylic acid polymer stain-resists can be dramatically improved either by co-applying the methacrylic acid polymer stain-resist with a water-dispersed epoxy resin, or by post-treatment of the methacrylic acid polymer stain-resist-treated polyamide fiber substrate with a water-dispersed epoxy resin. It appears that crosslinking with the epoxy resin locks the methacrylic acid polymer stain-resist in or onto the fiber and thus prevents excessive dissolution during alkaline shampoo treatment. The epoxy resin itself neither contributes to stain-resistance nor does it appear to be exhausted onto the polyamide fiber. It is essential to avoid any reaction of the epoxy resin and the methacrylic acid polymer stain-resists prior to their being applied to the polyamide substrate, because such a reaction product will not be capable of imparting stain-resistance to polyamide substrates.

DETAILED DESCRIPTION OF THE INVENTION

Shampoo treatments typically utilize aqueous surfactant solutions with pH values of about 10. Such treatments remove part or all of the methacrylic acid polymer stain-resist agent. The current invention provides a means to render such stain-resist agents less soluble by crosslinking the stain-resist agent so that the stain-resist properties of a stain-resist-treated polyamide substrate are retained to a greater extent after the treated substrate has been shampooed. The present invention provides a method of combining epoxy resins with stain-resists based on poly(methacrylic acid) and/or copolymers of methacrylic acid, which greatly improves the shampoo resistance of the treated substrate without introducing yellowing instability to UV and $NO_x$ exposures.

The present invention relates to novel compositions for imparting more durable stain-resistance to polyamide fiber substrates comprising blends of epoxy resins with methacrylic acid polymer stain-resists comprising either (I) copolymers containing more than 75 weight percent methacrylic acid or (II) polymers prepared by polymerizing methacrylic acid or mixtures of more than 75 weight percent methacrylic acid and less than 25 weight percent of one or more other ethylenically unsaturated monomers in the presence of a sulfonated phenolformaldehyde condensation product. This invention relates also to a process for imparting resistance to staining of polyamide substrates caused by acid dyes which consists essentially of (1) applying to said substrates (A) epoxy resins and (B) said methacrylic acid polymer stain-resists, and (2) heating the so-treated substrate to an elevated temperature sufficient to effect reaction between said epoxy resins and said methacrylic acid polymer stain-resists(thus, such elevated temperatures will be apparent to those skilled in the art from observation of such reactions). The present invention relates also to the resulting polyamide substrates having said epoxy resins and said methacrylic acid polymer stain-resists reacted on them at said elevated temperatures.

In a preferred embodiment, said epoxy resins and said methacrylic acid polymer stain-resists are mixed with one another and applied to the polyamide substrate as aqueous blends, following which the treated substrate is heated as described above. Thus, for example, one can use an application technique which uses the least amount of water, e.g. by padding, Kuster/knife roll, or print roll application. While use of the foregoing application technique involving the use of the least amount of water is preferred, in the alternative, one can use a technique in which the blend is applied at a higher liquor-to-goods ratio, e.g. by flex-nip application. In another embodiment, one can use any of the foregoing techniques to first apply said methacrylic acid polymer stain-resist to the polyamide substrate, then apply said epoxy resin to the substrate, and then heat the treated substrate to a temperature sufficient to effect reaction between the epoxy resin and the methacrylic acid polymer stain-resist. Said methacrylic acid polymer stain-resist and said epoxy resin are usually applied at temperatures in the range between 20° and 60° C. The treated polyamide fiber substrate can then be dried and cured with dry heat, or steam-cured and dried, at elevated temperatures in the range between 50° and 200° C. for periods of one minute to one hour, thereby providing a polyamide fiber substrate on which said epoxy resin and methacrylic acid polymer acid stain-resist have been reacted at said elevated temperature.

The amounts of said methacrylic acid polymer stain-resists and said epoxy resins to be applied to the polyamide substrates can be determined by observation. Thus the minimum amounts of each are those which are sufficient to provide the polyamide substrates with durable resistance to staining by acid dyes. Obviously, amounts in excess of those needed to effect optimum stain-resistance are uneconomical, but they are undesirable for yet another reason. Excessive amounts will stiffen the substrates; indeed, such amounts will adversely affect the "hand" of a polyamide fibrous substrate. For example, one can use between 0.3 and 2% by weight of methacrylic acid polymer stain-resist, based on the weight of the polyamide substrate. The amount of the epoxy resin needed to improve performance may range between 5 and 100% of the weight of said methacrylic acid polymer stain-resist, preferably between 10 and 50%. The methacrylic acid polymer stain-resist agents of this invention show poor resistance to high pH values, particularly the pH of about 10 found in some commercial shampoo formulations. To be effective, the stain-resist agents should be applied at pH values below 4.0, preferably between 2.0 to 2.5. The methacrylic acid polymer stain-resist agents of this invention can be applied in combination with sulfonated phenol/formaldehyde condensates, such as those described in U.S. Pat. Nos. 4,948,650, 4,879,180, 4,865,885, 4,839212, 4,822,373, 4,789,099, and 4,592,940.

The epoxy resins useful for the purposes of this invention are diverse in nature. The water-dispersible epoxy resins useful for the purposes of this invention include any water-soluble or emulsifiable epoxy compounds containing two or more epoxy groups. Generally, these are resins of up to about 800 epoxy equivalent weight, preferably up to about 200, which may be saturated or unsaturated, aliphatic, cycloaliphatic, aromatic or heterocyclic. Such resins include epoxidized triglycerides, epoxy polyethers of polyhydric alcohols and phenols, glycidyl ethers of resins obtained by condensing an aldehyde with a polyhydric phenol, reaction products of polyhydric alcohols or phenols with a polyepoxide, polymers and copolymers of epoxy-containing monomers having at least one polymerizable ethylenic linkage, and epoxy esters of polybasic acids, including aliphatic diglycidyl ethers within the scope of Formula I below, such as ethylene glycol diglycidyl ether, propylene glycol diglycidyl ether, and trimethylene glycol diglycidyl ether. Related water-soluble or readily water-dispersible glycidyl ethers that may be used are the polyglycidyl ethers of polyhydric alcohols having two to four carbon atoms, such as of ethylene glycol, glycerol, trimethylene glycol, propylene glycol, butylene glycols, their dimers, trimers, and higher polymers and especially the water-soluble or water-dispersible glycidyl ethers having the structure of one of Formulas I, II and III.

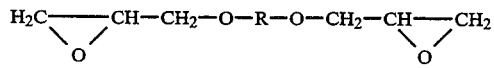

(I)

wherein R is an alkylene group of from two to six carbon atoms;

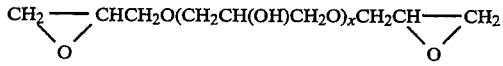

(II)

wherein x is a number having an average value of one to three;

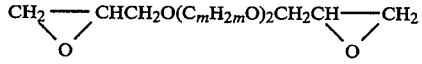

(III)

wherein m is an integer having a value of two to four, and x is a number having an average value of one to five. All of these polyepoxides contain at least two vic-epoxy groups in which the epoxy oxygen atom is attached to adjacent carbon atoms and have molecular weights of about 160–1000. The glycidyl ethers may preferably have molecular weights of about 180 to 400. Other examples of epoxy resins are described in the article on epoxy resins, Kirk-Othmer, Encyclopedia of Chemical Technology, 2nd Edition, Vol. 8, pages 294–312, John Wiley and Sons, Inc. N.Y. (1965).

However, for sake of convenience and economy, one should generally use commercial epoxy resins based on hisphenol A, novolacs, epichlorohydrin, glycidyl acrylate, glycidyl methacrylate or related materials. In addition to those described in the Examples herein which follow, see, for example, those described by Shell Chemical Company in "Epikote Technical Manual EP 2.5 2nd edition" (T2408/8.81/1000), "Formulation Notes" (EMULS-1 06/06/90), and "Specification Guide" (SC 21-90, 8/90), as well as those described by CIBA-GEIGY in "Resins and Hardeners Product Guide" (1990 CR1053BSM70). Epoxy resins based on Bisphenol A and epichlorohydrin are preferred, with "Custom Solution 287" water-dispersible Bisphenol A/epichlorohydrin-based epoxy resin being most preferred.

A dispersing agent such as polyvinylalcohol, a polyoxyethylene sorbitan monolaurate, or an octylphenoxypolyethoxyethanol may be employed to aid in the dispersion of those epoxy compounds which are not readily water-soluble. Their solubility in aqueous systems may also be improved by the addition of a lower alcohol, such as ethanol, isopropanol, and the like. Such methods of improving dispersibility are well known.

In one embodiment, copolymers suitable for the purposes of the present invention consist essentially of more than 75 weight percent of methacrylic acid and less than 25 weight percent of one or more ethylenically unsaturated monomers other than methacrylic acid. Such ethylenically unsaturated monomers include, for example, monocarboxylic acids, polycarboxylic acids, and anhydrides; substituted and unsubstituted esters and amides of carboxylic acids and anhydrides; nitriles; vinyl monomers; vinylidene monomers; monoolefinic and polyolefinic monomers; and heterocyclic monomers. Representative specific comonomers include, for example, acrylic acid, itaconic acid, citraconic acid, aconitic acid, maleic acid, maleic anhydride, fumaric acid, crotonic acid, cinnamic acid, oleic acid, palmitic acid, vinyl sulfonic acid, vinyl phosphonic acid, alkyl or cycloalkyl esters of the foregoing acids, the alkyl or cycloalkyl groups having 1 to 18 carbon atoms such as, for example, ethyl, butyl, 2-ethylhexyl, octadecyl, 2-sulfoethyl, acetoxyethyl, cyanoethyl, hydroxyethyl and hydroxypropyl acrylates and methacrylates, and amides of the foregoing acids, such as, for example acrylamide, methacrylamide, methylolacrylamide, and 1,1-dimethylsulfoethyl-acrylamide, acrylonitrile, methacrylonitrile, styrene, a-methylstyrene, p-hydroxy-styrene, chlorostyrene, sulfostyrene, vinyl alcohol, N-vinyl pyrrolidone, vinyl acetate, vinyl chloride, vinyl ethers, vinyl sulfides, vinyl toluene, butadiene, isoprene, chloroprene, ethylene, isobutylene, vinylidene chloride, sulfated castor oil, sulfated sperm oil, sulfated soybean oil, and sulfonated dehydrated castor oil. Particularly useful monomers include, for example, alkyl acrylates having 1-4 carbon atoms, itaconic acid, sodium sulfostyrene, and sulfated castor oil. Mixtures of the monomers, such as, for example, sodium sulfostyrene and styrene, and sulfated castor oil and acrylic acid, can be copolymerized with the methacrylic acid. The foregoing polymers and their preparation are disclosed in U.S. Pat. No. 4,937, 123, the contents of which are incorporated herein by reference.

In another embodiment, the methacrylic acid polymers suitable for the purposes of the present invention relate to those prepared by polymerizing methacrylic acid, with or without at least one other ethylenically unsaturated monomers described above, in the presence of sulfonated hydroxy-aromatic compound/formaldehyde condensation resins. Those homopolymers and copolymers and their preparation are described in U.S. Pat. No. 4,940,757, the contents of which are incorporated herein by reference. Typically, methacrylic acid, or a methacrylic acid copolymer (described above), is mixed with a sulfonated aromatic resin solution in a ratio ranging from 30:1 to 1:1 of methacrylic acid to sulfonated phenol-formaldehyde condensation resin solids, with a preferred ratio of o approximately 8:1. For example, 16 grams of glacial methacrylic acid can be mixed with 6 grams of a 30% solids solution of sulfonated condensation resin (1.8 grams of solid). A free radical chain initiator such as potassium persulfate, ammonium persulfate, or sodium persulfate is added to initiate polymerization. The reaction is heated to approximately 50°-100° C. with stirring for a time ranging from about 30 minutes to 2 hours on a laboratory bench scale, or a time sufficient to react all but less than about 1% monomer. Preferred reaction conditions are at 90° C. for 1 hour. The resulting cooled polymeric solution has an acidic pH, and typically 12-15 grams of solids per 100 grams of solution. If there are more than 15 percent solids in the solution, the solution approaches the form of a gel. As the ratio of the methacrylic acid to resin decreases, the viscosity of the resulting solution decreases. Viscosity can be adjusted with hydrotropes such as sodium xylene sulfonate, sodium cumene sulfonate, sodium toluene sulfonate or sodium dodecyl diphenyl oxide disulfonate.

Sulfonated hydroxyaromatic resins useful for purposes of this invention can be purchased commercially, such as CB-130 (Grifftex Corp.), Erional ® NW (Ciba-Geigy Limited), FX-369 (Minnesota Mining & Mfg. Co.), Cascofix ® NY (Gaston County Dyeing Machine Company), Tamol ® SN (Rohm & Haas Co.), Mesitol ® NBS (Mobay Corporation), Mylofixan ® P (Sandoz Corp.), and Intratex ®N (Crompton & Knowles Corp.). The sulfonated aromatic resins are typically bought as a 30-40% solids aqueous solution, which can contain glycols. Between approximately 30% and 70% of the units of the condensation polymer should be sulfonated. A preferred polymeric composition is completely water-soluble and contains approximately 50 mole percent of monosulfonated aromatic units, 15 mole percent of disulfonated aromatics units, and 34 mole percent of unsulfonated aromatic units.

The epoxy resins were dispersed in water by using dispersion procedures which are well-known in their fields of manufacture and formulation, e.g. techniques described by Shell Chemical Company in "Epikote Technical Manual EP 2.5 2nd edition" (T2408/8.81/1000) and in "Formulation Notes" (EMULS-1 06/06/90).

TEST METHODS

The following test methods were used to evaluate the carpet:

1. Stain Test

A nylon polyamide carpet specimen (3×5 inch) is placed on a flat non-absorbent surface. Twenty ml of a red dye solution consisting of 0.2 g FD&C Red 40 and 3.2 g citric acid in 1 liter of aleionized water is poured into a 2-inch diameter cylinder which is placed tightly over the specimen. The cylinder is removed after all the red dye solution has been absorbed. The stained carpet specimen is left undisturbed for 24 hours, after which it is rinsed thoroughly under cold tap water and squeezed dry. Each specimen is visually inspected and the amount of color remaining in the stained area rated according to the following stain rating scale:

5=no staining
4=slight staining
3=noticeable staining
2=considerable staining

1 = heavy staining

A stain rating of 5 is excellent, showing outstanding stain-resistance, whereas 1 is the worst rating, comparable to an untreated control sample.

2. Shampoo-Wash Durability Test

A 3×5 inch nylon carpet specimen is submerged for 5 minutes at room temperature in a detergent solution consisting of sodium lauryl sulfate (dodecyl sodium sulfate) such as "Duponol WAQE" (1.5 g per liter) and adjusted with dilute sodium carbonate to a pH of 10. The specimen is then removed, rinsed thoroughly under tap water, de-watered by squeezing, and air-dried. The dry carpet specimen is then tested according to the Stain Test described above.

The following Examples are given by way of illustration, not limitation. Unless indicated otherwise, all parts and percentages are by weight and all temperatures are in degrees Celsius.

EXAMPLE 1

To an agitated mixture of 8.5 g of 70 wt. % of sulfated castor oil in 55 g of water at 90 deg. C was added simultaneously over a 50 minute period a solution consisting of 38 g of methacrylic acid, 6 g of n-butyl methacrylate, 5 g of water, and a solution of 5 g of ammonium persulfate in 40 g water. The reaction mass was further agitated for another 2 hours at 90 deg. C to allow for completion of the polymerization to a 76 wt. % methacrylic acid terpolymer. The reaction product was then cooled to 65 deg. C before the addition of 11.1 g of 30 wt. % of aqueous sodium hydroxide. The resulting hazy solution contained about 30 wt. % of methacrylic acid terpolymer.

Control Solution 1

8.2 g of 30 wt. % of above methacrylic acid terpolymer was diluted with 335.3 g of water, adjusted to pH of 2.0 with 6.5 g of 13 wt. % of sulfamic acid and heated to 40 deg. C.

Solution 1-A 8.2 g of 30 wt. % of above methacrylic acid terpolymer was diluted with 319.3 g of water, heated to 40 deg. C, and adjusted to pH of 2.0 with 6.5 g of 13 wt. % of sulfamic acid before the addition of 16 g of 15.5 wt. % of Epon "Custom Solution 287" emulsion.

Solution 1-B 8.2 g of 30 wt. % of above methacrylic acid terpolymer was diluted with 319.3 g of water, heated to 40 deg. C., and adjusted to pH of 2.0 with 6.5 g of 13 wt. % of sulfamic acid before the addition of 16 g of 7.7 wt. % of Epon "Custom Solution 287" emulsion.

The above solutions were applied by padding onto white, level-loop nylon 6/6 carpet at a 110–120 % wet-pick-up. The thus treated carpet samples were dried for 30 minutes at 120 deg. C. and tested according to the "Stain" and "Shampoo-Wash Durability" methods. The actual loading of the chemicals, expressed as percent on the weight of fiber (% owf), was calculated from the measured wet-pickup. The test results are shown in Table I.

EXAMPLE 2

The methacrylic acid polymer was made according to Example 1 of U.S. Pat. No. 4,940,757 by polymerizing 163.8 g of methacrylic acid in the presence of 1156.4 g of water and 61.3 g of a 30 wt. % solution of a formaldehyde condensate of sulfonated 4,4 '-sulfonyldiphenol with 1.1 g of potassium persulfate. The resulting clear, yellowish solution contained about 13.2 wt. % of active ingredient.

Control Solution 2

18.6 g of above 13.2 wt. % methacrylic acid polymer was diluted with 327 g of water, adjusted to pH of 2.0 with 3.9 g of 13 wt. % of sulfamic acid and heated to 40 deg. C.

Solution 2-A 18.6 g of above 13.2 wt. % methacrylic acid polymer was diluted with 311.5 g of water, heated to 40 deg. C., and adjusted to pH of 2.0 with 3.9 g of 13 wt. % of sulfamic acid before the addition of 16 g of 15.5 wt. % of Ciba-Geigy's "MS 9772" epoxide.

The above solutions were applied by padding on white, level-loop nylon 6/6 carpet at a 100–105 % wet-pick-up. The thus treated carpet samples were dried for 30 minutes at 120 deg. C. and tested according to the "Stain" and "Shampoo-Wash Durability" methods. The actual loading of the chemicals, expressed as percent on the weight of fiber (% owl), was calculated from the measured wet-pick-up. The test results are shown in Table I.

TABLE I

| TREATMENT SOLUTION | METHACRYLIC ACID POLYMER (% owf) | EPOXIDE (% owf) | RED DYE SOLUTION STAINING (24 HOURS) INITIAL | AFTER SHAMPOO |
|---|---|---|---|---|
| Control Solution 1 | 0.79 | No | 5 | 1 |
| Solution 1-A | 0.82 | 0.83 | 5 | 3 |
| Solution 1-B | 0.76 | 0.38 | 5 | 3 |
| Control Solution 2 | 0.72 | No | 4 | 2–3 |
| Solution 2-A | 0.71 | 0.90 | 5 | 3 |

I claim:

1. A process for imparting to polyamide substrates resistance to staining by acid dyes which is durable to shampooing and resistance to yellowing caused by exposure to UV and $NO_x$, comprising applying to said substrate (A) one or more epoxy resins and (B) a polymeric stain-resist agent consisting essentially of (i) copolymers containing more than 75 weight percent methacrylic acid and less than 25 weight percent of one or more other ethylenically unsaturated monomers, or (ii) polymers prepared by polymerizing (a) methacrylic acid or (b) mixtures of methacrylic acid and one or more other ethylenically unsaturated monomers, in the presence of a sulfonated hydroxyaromatic-formaldehyde condensation product.

2. The process of claim 1 wherein said polymeric stain-resist agent comprises a polymer prepared by polymerizing methacrylic acid in the presence of a sulfonated hydroxyaromatic-formaldehyde condensation product.

3. The process of claim 2 wherein said condensation product is a sulfonated phenol-formaldehyde condensate.

4. The process of claim 1 wherein said epoxy resin is a novolacepichlorohydrin resin.

5. The process of claim 1 wherein said epoxy resin is a bisphenol A-epichlorohydrin resin.

6. The process of claim 1 wherein said epoxy resin is a hydrogenated bisphenol A-epichlorohydrin resin.

7. The process of claim 1 wherein said epoxy resin comprises 5 to 100% by weight of said polymeric stain-resist.

8. The process of any of claims 1, 2, 3, 4, 5, 6, or 7 wherein said epoxy resins and said polymeric stain-resist agents are applied as a blend.

9. A polyamide substrate prepared in accordance with the process of claim 8, which substrate has resistance to staining by acid dyes which is durable to shampooing and resistance to yellowing caused by exposure to UV and/or $NO_x$.

10. The process of either claim 1, 2, 3, 4, 5, 6, or 7 which comprises applying one or more of said polymeric stain-resist agents to said substrate, and thereafter applying one or more of said epoxy resins to said substrate.

11. A polyamide substrate prepared in accordance with the process of claim 10, which substrate has resistance to staining by acid dyes which is durable to shampooing and resistance to yellowing caused by exposure to UV and/or $NO_x$.

* * * * *